US005119424A

United States Patent [19]

Asakawa et al.

[11] Patent Number: 5,119,424

[45] Date of Patent: Jun. 2, 1992

[54] SPEECH CODING SYSTEM USING EXCITATION PULSE TRAIN

[75] Inventors: Yoshiaki Asakawa, Kawasaki; Akira Ichikawa, Musashino; Kazuhiro Kondo, Fuchu; Toshiro Suzuki, Tama, all of Japan

[73] Assignee: Hitachi, Ltd., Tokyo, Japan

[21] Appl. No.: 282,497

[22] Filed: Dec. 12, 1988

[30] Foreign Application Priority Data

Dec. 14, 1987 [JP] Japan ..... 62-315621

[51] Int. Cl.[5] ..... G10L 9/04

[52] U.S. Cl. ..... 381/34; 381/38; 381/40

[58] Field of Search ..... 381/29-40; 364/513.5

[56] References Cited

U.S. PATENT DOCUMENTS

| | | | |
|---|---|---|---|
| 4,516,259 | 5/1985 | Yato et al. | 381/30 |
| 4,696,038 | 9/1987 | Doddington et al. | 381/38 |
| 4,720,861 | 1/1988 | Bertrand | 381/36 |
| 4,720,862 | 1/1988 | Nakata et al. | 381/38 |
| 4,802,221 | 1/1989 | Jibbe | 381/30 |
| 4,821,324 | 4/1989 | Ozawa et al. | 381/31 |
| 4,873,723 | 10/1989 | Shibagaki et al. | 381/36 |
| 4,881,267 | 11/1989 | Taguchi | 381/40 |

OTHER PUBLICATIONS

Transactions of the Committee on Speech Research, The Acoustical Society of Japan, Jan. 24, 1984, p. 617 (abstract).

*Primary Examiner*—Dale M. Shaw
*Assistant Examiner*—David D. Knepper
*Attorney, Agent, or Firm*—Antonelli, Terry, Stout & Kraus

[57] ABSTRACT

A speech signal is analyzed for each frame so that it is separated into spectral envelope information and excitation information, and the excitation information is expressed by a plurality of pulses. Judgement is conducted as to whether the current frame is a voiced frame immediately after the transition from an unvoiced frame, a voiced frame continuative from a voiced frame or an unvoiced frame, and excitation pulses are generated in accordance with the judgement result. In case of a continuing voiced frame, the excitation pulse position of the current voiced frame is determined based on the pitch period with respect to the excitation pulse position of the immediately preceding voiced frame so that the excitation pulse train is generated at a position approximated to the determined position.

16 Claims, 13 Drawing Sheets

SPEECH CODING SYSTEM USING EXCITATION PULSE TRAIN

BACKGROUND OF THE INVENTION

This invention relates to a speech coding system, and particularly to a system for improving the quality of coded and decoded speech when compressing the speech information to about 8 kbps (kilobits per second).

For the PCM transmission of a speech signal over a broad-band cable, it is sampled, quantized and transformed into a binary digital signal. The transmission bit rate is 64 kbps.

In establishing a communication network using leased digital lines, reduction in the communication cost is a critical concern, and speech signals which contain as much information volume as 60 kbps cannot be transmitted directly. To cope this problem, it is necessary to compress the information (i.e., low bit-rate coding) for the transmission of such speech signals.

A known method of compressing a speech signal to about 8 kbps is to separate the speech signal into spectrum envelope information and excitation information, and code the information individually. A method of separating the speech signal into the spectrum envelope information and excitation information will be described in the following. It is assumed that the speech waveform is already sampled and transformed into a series of sample values $x_t$, in which the present sample value is $x_t$ and the preceding p pieces of sample values are $\{x_{t-i}\}$ (where $i=1, 2, \ldots, p$). Another assumption is that the speech waveform can be predicted approximately from p pieces of preceding samples. Among the prediction schemes, the simplest linear prediction approximates the current value by summing old sample values each multiplied by a certain coefficient. The difference between the real value $x_t$ and predicted value $y_t$ at present time t is the prediction error $\epsilon$, which is also called "prediction residual" or simply "residual". The prediction residual waveform of a speech waveform is supposed to be the sum of two kinds of waveforms. One is an error component, which has a moderate amplitude and is similar to a random noise waveform. The other is an error attributable to the entry of a voiced sound pulse, which is very unpredictable, resulting in a residual waveform with a large amplitude. The error component appears cyclically in the periodicity of the source sound.

Speech has sections with periodicity (voiced sound) and sections without significant periodicity (unvoiced sound), and correspondingly the prediction residual waveform has periodicity in its voiced sound sections.

The so-called PARCOR (Partial Autocorrelation) method produces a model of residual waveform using a single pulse train for the voiced sound and using the white noise for the unvoiced sound, and it works for low bit-rate coding, while it suffers a significant quality degradation. Other methods which express the original sound by several pulse trains include: the multi-pulse excitation method (refer to Transactions of the Committee on Speech Research pp. 617–624, The Acoustical Society of Japan, entitled "Quality Modification in Multi-pulse Speech Coding System", S83-78 (Jan. 1984), by Ozawa, et al.) and the thinned-out residual method (refer to Digests of Conference in Oct. 1984, pp. 169–170, The Acoustical Society of Japan, entitled "Speech Synthesis Using Residual Information", by Yukawa, et al.).

In the above conventional techniques, an excitation pulse train is generated based on a certain formulation for each frame independently. The frame is a time unit for the speech analysis and it is set to about 20 ms in general. In the multi-pulse method and thinned-out residual method, generated pulse trains can be regarded as the approximation of the residual, and therefore voiced sound sections seem to have a periodicity. However, since a pulse train is generated independently of the preceding and following frames, each frame has a different relative positional relation in the pulse train, resulting possibly in the fluctuation of periodicity. Synthesizing speech based on such pulse trains unfavorably results in a quality degradation, such as the creation of rumbling.

SUMMARY OF THE INVENTION

An object of this invention is to overcome the foregoing prior art deficiency and provide a speech coding system capable of preventing the quality degradation caused by the fluctuation of periodicity among frames for the pulse train generated by the multi-pulse method or thinned-out residual method.

In order to achieve the above objective, according to one aspect of this invention, the speech coding system comprises means for judging whether the input frame is a voiced frame immediately following an unvoiced frame, a voiced frame continuing from a voiced frame, or an unvoiced frame, first excitation pulse generation means which generates excitation pulses immediately following the transition from an unvoiced frame to a voiced frame, second excitation pulse generation means which generates excitation pulses for a continuing voiced frame, and third excitation pulse generation means which generates excitation pulses for an unvoiced frame.

The principle of the inventive speech coding system is as follows. A first-generated pulse train is made reference to infer, based on the pitch period, the position of a pulse train of the next frame so that the periodicity is retained. For the initial reference frame, e.g., the first frame following the transition from an unvoiced to a voiced frame, an excitation pulse train is generated under a certain formulation (will be explained later), and thereafter a subsequent excitation pulse train is generated through the inference of the position of the excitation pulse train of the next frame by making reference to the former excitation pulse train.

In the multi-pulse method and thinned-out residual method, the number of excitation pulses is small, and therefore generated excitation pulse trains form isolated blocks for each pitch period. Accordingly, by making reference to the excitation pulse train of the last pitch period of a frame, the leading pulse train of the next frame is positioned to the time point which is advanced by the pitch period from the previous pulse train position. The periodicity of a pulse train between the two frames is thus retained. For the subsequent frame, reference is made to the above position to generate a first excitation pulse train. Consequently, the fluctuation of periodicity among frames does not occur, preventing the quality degradation, and optimal excitation pulse trains based on the formulation of pulse train generation are obtained.

DESCRIPTION OF THE PREFERRED EMBODIMENTS

An embodiment of this invention will be described in detail with reference to the drawings.

Figure 1A:
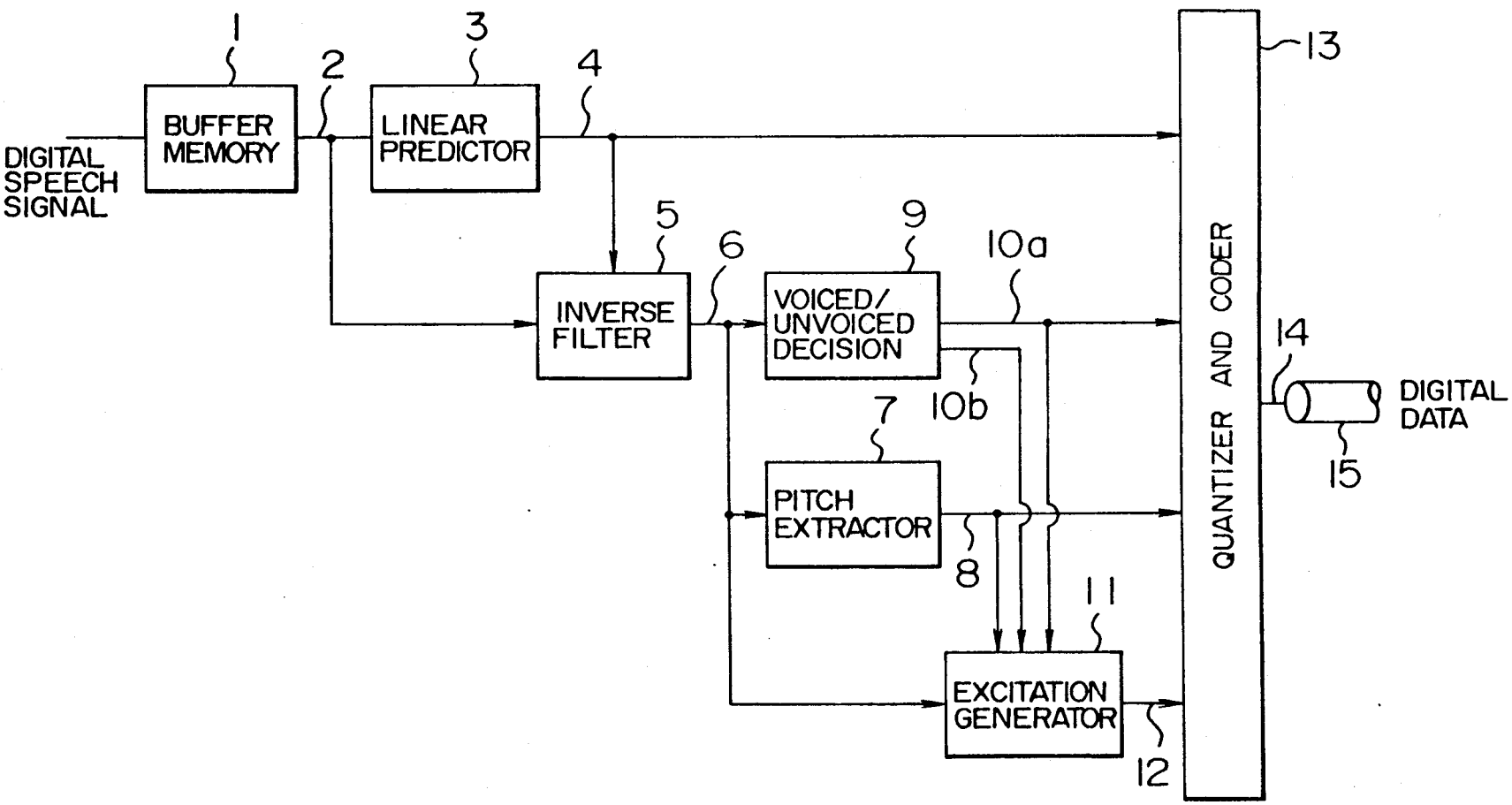
FIGS. 1*a* and 1*b* are block diagrams of the speech coding system embodying the present invention.
Figure 1B:
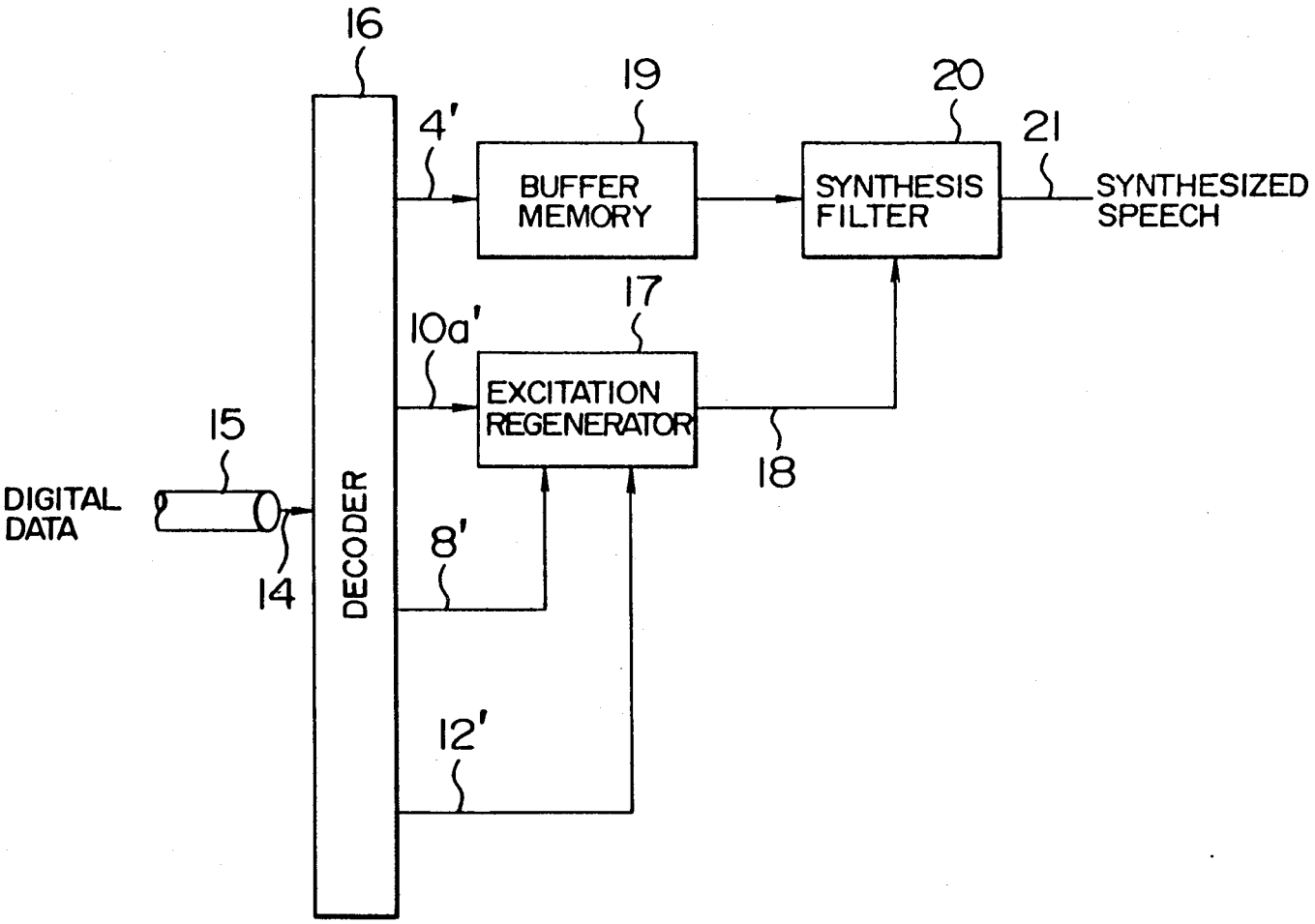

FIGS. 1*a* and 1*b* show in a block diagram the inventive speech coding system which is applied to the speech coder (speech CODEC) based on the thinned-out residual method. FIG. 1*a* is the coding section, and FIG. 1*b* is the decoding section.

The coding section shown in FIG. 1*a* includes a buffer memory for storing a digital speech signal, a linear prediction circuit 3, an inverse filter 5 which is controlled through parameters 4, a pitch extraction circuit 7 operating on the basis of the residual correlation method or the like, a voice/unvoice judgement circuit 9, an excitation generator 11 which generates excitation pulses depending on the voice/unvoice judgement result, and a quantization coder 13.

The decoding section shown in FIG. 1*b* includes a decoding circuit which separates the input signal into four kinds of parameters, a buffer memory 19 for storing a decoded spectral parameter, an excitation pulse regenerator 17 which reproduces excitation pulses from the pitch period, voice/unvoice judgement result and excitation information, and a synthesis filter 20 which operates to compensate the delay caused by the excitation pulse regenerator 17.

Referring to FIG. 1*a* for the coding operation, a digitized speech signal for one frame is stored in the buffer memory 1, and it is transformed into parameters representing a spectrum envelope (e.g., partial auto-correlation coefficients) by means of the well-known linear prediction circuit 3. The parameters 4 are used as coefficients to control the inverse filter 5, which receives the speech signal 2 to produce a residual signal 6. The pitch extraction circuit 7 employs a well-known method such as the residual correlation method and AMDF (Average Magnitude Differential Function) method, and it extracts a pitch period 8 of the frame from the residual signal 6. The voice/unvoice judgement circuit 9 produces a signal 10*a* indicating whether the frame is a voiced frame or unvoiced frame and a signal 10*b* indicating the transition from an unvoiced to a voiced frame. The excitation generator 11 is a functional block which is newly introduced by this invention, and it produces excitation pulses 12 depending on the voice-/unvoice judgement result 10*a* and the transition signal 10*b*. The quantizing coder 13 receives the spectral parameters 4, pitch period 8, voice/unvoice judgement result 10*a* and excitation information 12, and quantizes the input information into a certain number of bits in a certain format and sends out the result 14 over a digital line 15.

In FIG. 1*b* for the decoding operation, the digital data 14 sent over the digital line 14 is received by the decoder 16, which separates the data into four kinds of parameters, i.e. pitch information 8', excitation information 12', voice/unvoice judgement result 10*a'*, and spectral parameter 4'. Among those parameters, three kinds of parameters (decoded pitch period 8', voice/unvoice judgement result 10*a'* and excitation information 12') are applied to the excitation regenerator 17, which then produces intended excitation pulses 18. The remaining parameter (decoded spectral parameter 4') is stored in the buffer memory 19 so that it is used as a coefficient for the synthesis filter 20 following the compensation of a delay in the excitation regenerator 17. The excitation pulses 18 are supplied to the synthesis filter 20, which then produces synthesized speech 21.

Figure 2:
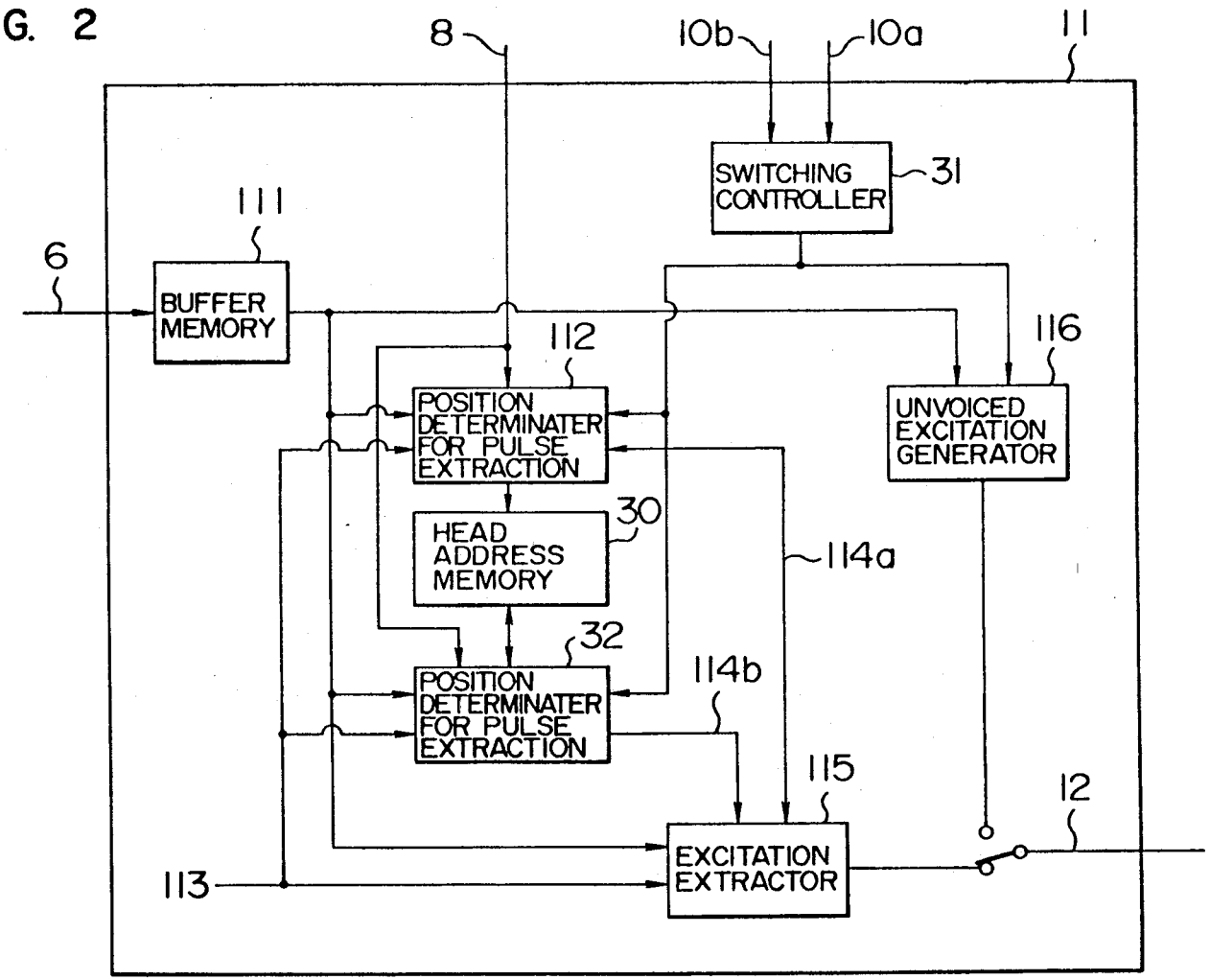
FIG. 2 is a block diagram of the excitation generator in FIG. 1*a*.

FIG. 2 is a functional block diagram of the excitation generator 11 in FIG. 1*a*. The excitation generator 11 comprises a switching controller 31 which switches control in response to the transition from a voiced to unvoiced frame, a buffer memory 111 for storing the residual signal, a pulse extraction position determinator 112 operating at a transition from an unvoiced to a voiced frame, a head address memory 30 for storing the head address, in terms of the address of buffer memory 111, of the representative residual determined in the previous frame, a pulse extraction position determinator 32 operating when a continuing voiced frame is entered, an excitation extractor 115 which extracts the excitation based on the head address and buffer memory 111, and an unvoiced excitation generator 116.

Since the speech coding system of this embodiment is pertinent to the excitation generation of voiced frames, it is assumed that the voice/unvoice judgement result 10*a* indicates "voice" and the pitch period 8 has its value established (it is assumed to be HPTCH in the following).

Initially, when the signal 10*b* indicates the transition from an unvoiced to a voiced frame, the signal from the switching controller 31 transfers control to the pulse extraction position determinator (I) 112. The function of the excitation generator 11 under control of 112 is realized by the second method described in U.S. Pat. application Ser. No. 878,434 filed on Jun. 25, 1986, now abandoned. Namely, consecutive residual pulses of LN in number are extracted in a representative pitch section (LN is the value indicated as the number of extracted pulses designated by line 113). In order to interpolate efficiently the decoded residual of the previous frame and the representative residual of the current frame at the time of decoding, the representative pitch section is determined to include the last point of the current frame (which will be detailed later). The pulse extraction position determinator (I) 112 calculates the following formula.

$$AMP(i) = \sum_{j=i}^{i+LN-1} |X_j| \quad (1)$$

where i satisfies the following condition:

$$iFRM\text{-}NPTCH+1 \leqq i \leqq iFRM \quad (2)$$

In formula (1), $x_j$ is the residual pulse amplitude of address j and it is read out of the buffer memory 111. The buffer memory 111 is a ring buffer, storing the residual between the previous frame and current frame. iFRM is the frame length, and LN is the number of extracted pulses indicated by line 113.

In order for the pulse extraction position determinator 112 to obtain the amplitude information and positional information of the next residual pulse to be interpolated, it first calculates the cumulative value of amplitude using the formulas (1) and (2). In case the buffer memory 111 is assigned with addresses 0-159 for the current frame length and 20 consecutive residual pulses exist in the representative pitch section, the next representative pitch section is determined to include the last point of the current frame, and the position i is set within a section which is smaller than the frame length and larger than a section smaller than the frame length by the pitch period, based on the formula (2). Interpolation takes place in such a way that the head address is obtained from the cumulative amplitude value calculated by the formula (1) and 20 residual pulses are read out of the buffer memory 111.

With AMP(i) having a maximum value at $i=i_0$, as calculated by formula (1), $i_0$ is the head address 114*a* of the representative residual. When the head address 114*a* is sent to the excitation extractor 115, it reads out LN pieces of residual starting from the head address of the buffer memory 111, and sends it to the latter stage as the excitation information 12.

Next, the case of the voice/unvoice transition signal 10*b* indicating continuous voiced frames will be described in detail. The signal from the switching controller 31 transfers control to the pulse extraction position determinator (II) 32. The buffer memory 111 stores the residual for two frames. Addresses from $-iFRM+1$ to 0 are for the previous frame, and addresses from 1 to iFRM are for the current frame. The head address memory 30 stores the head address $i_0$ of the representative residual determined in the previous frame by being converted to the address of the buffer memory 111 ($i_0'=i_0-iFRM$). The head position of the representative residual of the current frame is determined with reference to $i_0'$ as follows.

$$\left.\begin{array}{l} STADRS_1 = i_0' + NPTCH \\ STADRS_2 = STADRS_1 + NPTCH \\ \vdots \\ STADRS_N = STADRS_{N-1} + NPTCH \end{array}\right\} \quad (3)$$

In the formulas (3), $STADRS_1, \ldots, STADRS_N$ correspond to the head address for interpolating the representative residual at the time of decoding, and $STADRS_N$ is an address in the last pitch section of the current frame, i.e., the head address of the representative residual, which meets the following;

$$i_0 = STADRS_N \quad (4)$$

This extremely facilitates the evaluation of the head address of the representative residual of the current frame from that of the previous frame.

However, the pitch period NPTCH is an average pitch period of the current frame and therefore it possibly involves error from the actual pitch position. For more accurate determination of position, the following procedure is taken.

First, the short-section cross correlation is defined by the following formula (5):

$$COR(I) = \sum_{j=i}^{LN-1} X_{i+j} \cdot X_{i_0'+j} \quad (5)$$

$$i_0' + NPTCH - D \leqq i \leqq i_0' + NPTCH + D \quad (6)$$

Value D ($D>0$) is determined by the fluctuation of the pitch, and COR represents the cross correlation. The formula (6) indicates that the head of the first excitation pulse train of the previous frame resides within the range defined by the head of the representative residual of the previous frame which is expanded in consideration of the pitch period fluctuation, while the formula (5) is used to calculate the cumulative amplitude value of residual pulses for the extracted pulses of LN in number based on the head address and the cross correlation is maximum if the pulses have equal phase.

The following formula is used to calculate the first starting address.

$$STADRS_1 = \left\{ i \mid \max_i COR(i) \right\} \quad (7)$$

The formula (7) signifies to detect the position i which provides the highest correlation at a position which is distant by NPTCH from the representative residual of the previous frame. The same procedure is applied, while replacing $i_0'$ with $STADRS_1$ to obtain $STADRS_2$, sequentially up to $STADRS_N$ ($N=i_0$).

It is also possible to use the formula (1) in determining $STADRS_n$ (where n is an arbitrary integer). Applying the formula (6) to the range of i in the formula (1) induces the following formula (8):

$$STADRS_1 = \left\{ i \mid \max_i AMP(i) \right\} \quad (8)$$

Subsequently, in the same way as above, values up to $STADRS_N$ are obtained.

The head address $i_0$ 114*b* of the representative residual determined by any of the above procedures is sent to the excitation extractor 115.

At the time of decoding, excitation pulses are reproduced while interpolating the representative residual and decoded residual of the preceding frame. The method of decoding will be described in detail in the following.

Observation of the speech waveform reveals that a voiced sound portion (e.g., a vowel) is the repetition of a similar waveform. The same feature is found in the excitation waveform (residual waveform) produced through speech analysis. On this account, it is possible to compress the speech information by making a frame of original speech represented by an excitation waveform of one period (pitch period) so that it is used iteratively at the time of decoding. The actual speech waveform varies smoothly, whereas the synthesized speech produced from the iterative representative excitation is discontinuous at the boundary of the frames. Since the human audition is sensitive to an abrupt change in the speech spectrum, discontinuities in the synthesized speech spoil the quality. The discontinuity at the frame boundary can be alleviated by interpolating, in units of a pitch period, the representative excitation between adjacent frames so that the excitation waveform varies smoothly in its phase and amplitude. This invention is based on this principle, and, although the interpolated waveform does not coincide with the original waveform, it significantly effectuates the improvement of speech quality for the human audition.

Figure 3:
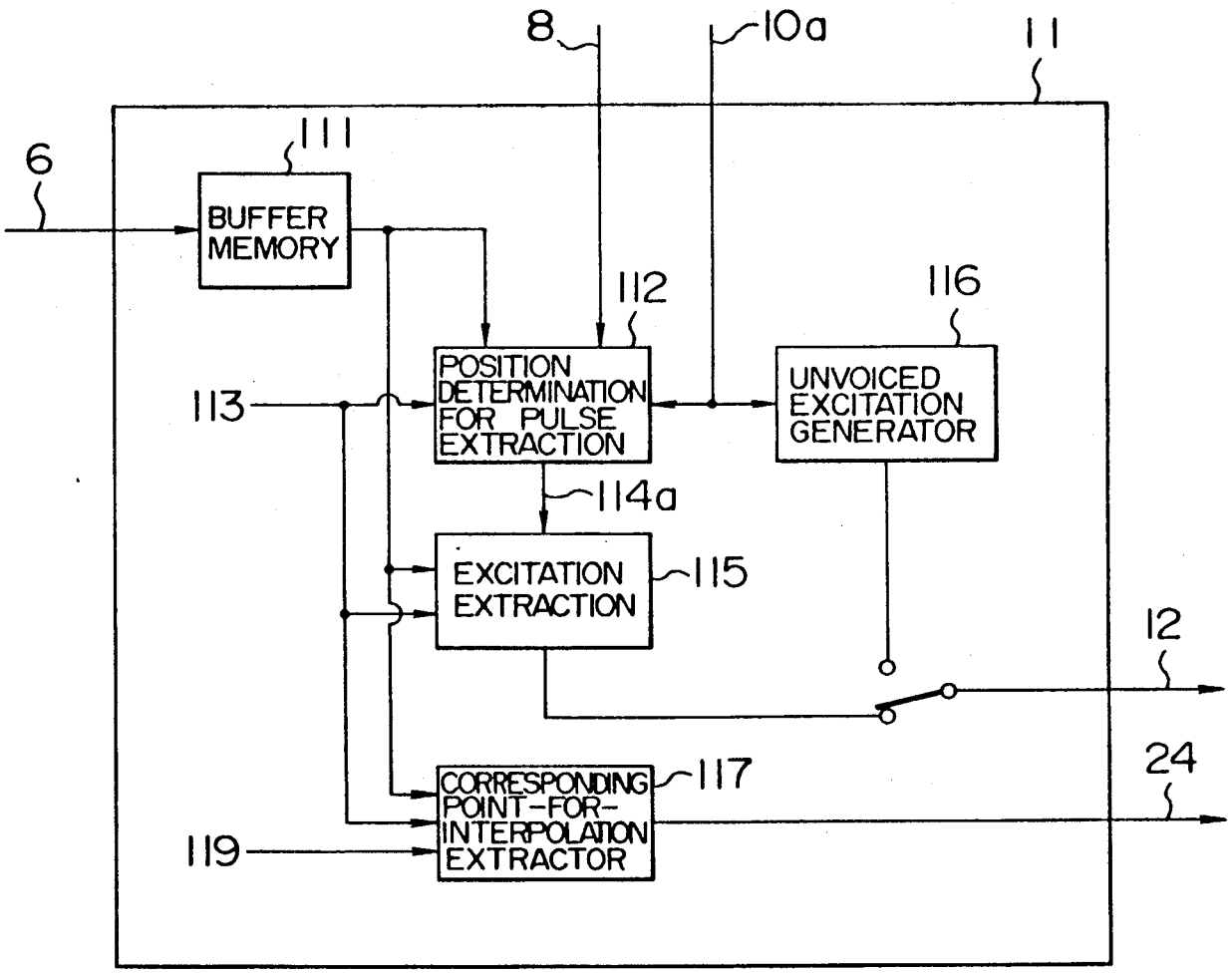
FIG. 3 is a block diagram of another excitation generator of the case of using interpolation.

Next, the function of the excitation generator 11 with the ability of interpolation will be described with reference to FIG. 3. Since this invention is pertinent to the excitation regeneration of voiced frames, the voice/unvoice judgement result 10*a* indicates "voice", and the pitch period 8 is assumed to have its value established (i.e., NPTCH).

Excitation pulses are consecutive residual pulses of LN in number extracted from a representative pitch section, as mentioned previously. For a frame length IFRM and residual pulse addresses 1 to IFRM, the representative pitch section is preferably determined to include the address IFRM. The reason is that, although it is generally necessary for the interpolation of excitation by a decoder to have the representative excitation of two frames at the front and back of that frame, by setting the representative pitch period as described above, only representative residuals of that frame and adjacent frames are required, and the coding delay can be minimized. Accordingly, the head address of the pitch section for extracting the representative residual becomes $i\phi = iFRM - NPTCH + 1$. In this case, if the number of pulses 113 to be extracted (LN) is larger than the pitch period 8 (NPTCH), the head address is set to be $i\phi = iFRM - LN + 1$. For this pitch section (address $i\phi$ to iFRM), the head address 114 (STADRS) of the residual to be extracted by the pulse extraction position determinator 112 is determined. The excitation extractor 115 makes reference to the head address 114*a* and the number of extracted pulses 113 to read out residual pulses from the buffer memory 111, and delivers the residual pulses of LN in number from the head address and the amplitude as the excitation information 12.

Next, the function of the corresponding point-for-interpolation extractor 117 will be described. Immediately following the transition from an unvoiced to a voiced frame the representative residual is extracted independently of the previous frame, and therefore excitation pulses must be addressed according to the pitch period. The number of pitches included in a portion before the representative pitch section of that frame is:

$$N = (iFRM - i\phi)/NPTCH(round\text{-}up) \tag{9}$$

The correspondence point address COADRS for $i\phi$ is determined, is a simplest manner, as follows.

$$COADRS_0 = i\phi - N \cdot NPTCH \tag{10}$$

Use of the formula (10) enables the determination of the correspondence point address in the decoding section. In the actual speech, the correspondence point address is not necessarily coincident with address ($COADRS_0$) evaluated by formula (10) due to the fluctuation of the pitch period or the like. A more accurate alternative manner of determination is as follows.

First, $COADRS_0$ is evaluated as a reference point using formula (10), and next the short-section correlation is calculated by the following formula (11).

$$\left.\begin{array}{l} COR(i) \sum_{j=0}^{LN} X_{i-j} X_{i\phi+j} \\ COADRS_0 - D \leqq i \leqq COADRS_0 + D \end{array}\right\} \tag{11}$$

where Xi is the residual amplitude of address i and it is read out of the buffer memory 111. Indicated by 119 in FIG. 3, (having a value of D) is the range of search for the correspondence points. The interpolation address COADRS is determined as follows.

$$COADRS = \left\{ i \mid \max_i COR(i) \right\} \tag{12}$$

In another method, correspondence points are determined using formulas (11) and (12) around addresses each shifted up by NPTCHS from $i\phi$, and finally COADRS is determined. The correspondence points are delivered as correspondence point information 24. It should be noted that, in case of a continuing voiced frame, the interpolation correspondence point address corresponds exactly to the representative residual position of the preceding frame, and therefore it is not necessary to determine the point exclusively.

Figure 4:
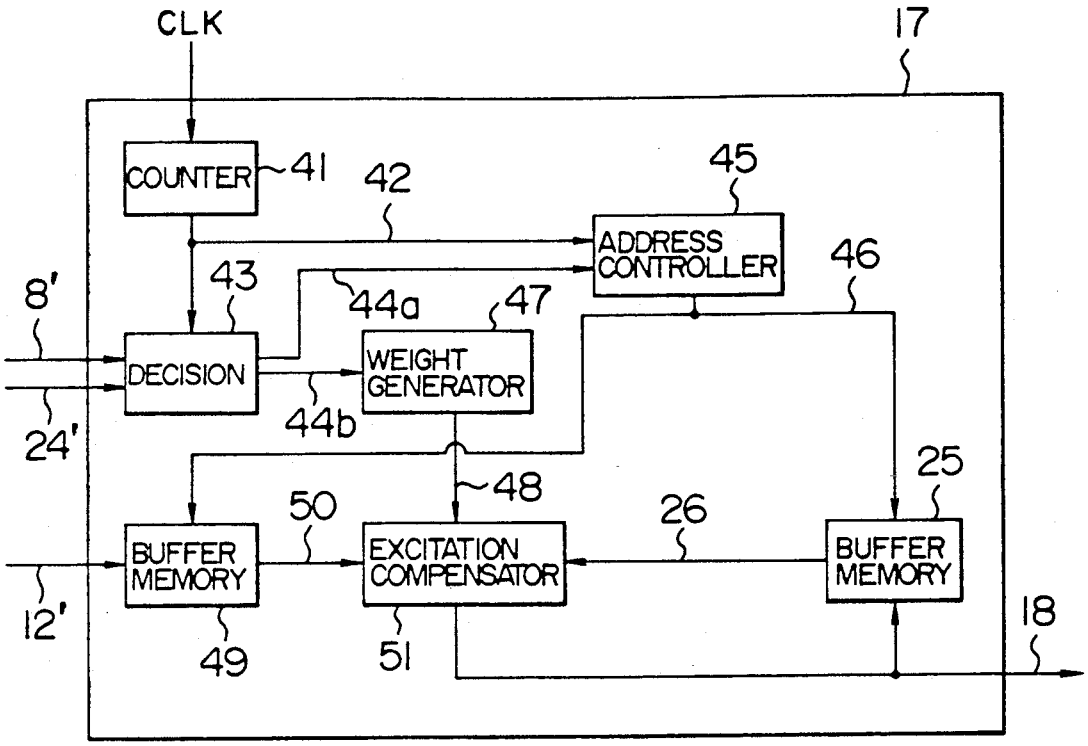
FIG. 4 is a block diagram of the excitation regenerator in FIG. 1*b*.

Next, the function of the excitation regenerator 17 in the decoding section will be described in detail with reference to FIG. 4. Indicated by 41 is a counter which operates to up-count in synchronism with a clock CLK, and 45 is an address controller which addresses a buffer 49 for storing a representative residual 12' and a buffer 25 for storing excitation pulses 18 of the previous frame in accordance with the count value 42. A decision maker 43 compares the count value 42, pitch period 8' and interpolation correspondence point 24' to produce a timing signal 44*a* and weighting mode 44*b* for to revise the weight of excitation pulse interpolation. A weight generator 47 determines the weight for the representative residual of the present frame and the regenerated excitation of the previous frame in accordance with the weight mode 44*b*. An excitation compensator 51 implements weighting summation for the representative residual pulses 50 read out of the buffer 49 and the regenerated excitation pulses 26 of the previous frame read out of the buffer 25 in response to the addresses 46, and delivers the compensated result 18. The result 18 is stored in the buffer 25 so that it is also used for the interpolation of the next frame.

The following explains the major functions of each of the functional blocks. The decision maker 43 sets the following two values at the beginning of a frame.

$$\begin{array}{l} K_3 = K_2 \\ i = 0 \end{array} \tag{13}$$

$K_2$ is the address value of the interpolation correspondence point 24', $K_3$ is the decision address for revising the weight, and is the pitch section number for the execution of interpolation. The number of pitch sections N is calculated in advance using formula (1). The counter value 42 indicates the address J (1 to IFRM) in the frame. The address J is compared with $K_3$, when J becomes greater than or equal to $K_3$.

$$J \geqq K_3 \quad (14)$$

The timing signal 44a is issued to revise iand $K_3$ as follows.

$$i = i + 1 \quad (15)$$

$$K_3 = K_3 + NPTCH \quad (16)$$

The formula (16) implies that the values are revised in every pitch. In case the interpolation point is determined using the formula (11), it is possible to revise $K_3$ so that the error from the result of calculation (9) is corrected. Subsequently, for the weight mode 44b of interpolation, MD is determined as follows.

$$MD = i*3/N(round\text{-}off) \quad (17)$$

formula (17) is for the case, as an example, of four weight modes (MD=0 to 3) dependent on the pitch section, and no confinement is intended to formula (17) provided that the mode is determined from i and N (or NPTCH).

The address controller 45 is responsive to the timing signal 44a to reset the read address ii of buffer 49 and the read address JJ of buffer 25 as follows.

$$ii = 1 \quad (18)$$

$$JJ = K_2 \quad (19)$$

The addresses ii and JJ are incremented by one at each pulse reading. In this case, when JJ=1, it is set as JJ=JJ−NPTCH and the regenerated excitation of the previous frame is used cyclically.

The weight generator 47 determines a weight $W_1$ for excitation pulses 50 and a weight $W_2$ for excitation pulses 26 in accordance with the weight mode MD. An example of this procedure is to make a table as shown below in advance and read out the table depending on the value of MD.

| MD | $W_1$ | $W_2$ |
|---|---|---|
| 0 | 0.25 | 0.75 |
| 1 | 0.5 | 0.5 |
| 2 | 0.75 | 0.25 |
| 3 | 1.0 | 0.0 |

Figure 5:
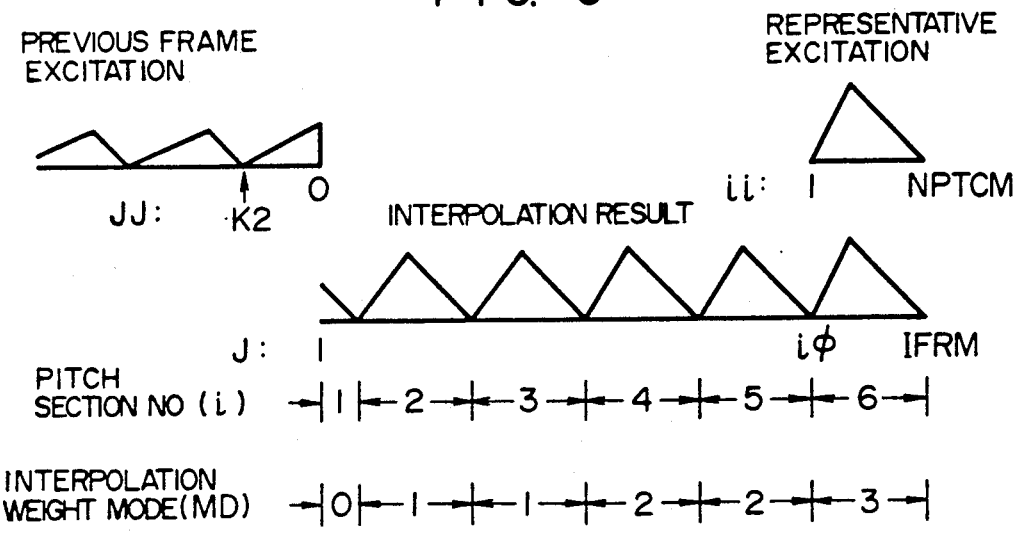
FIG. 5 is a diagram showing, in a sense of model, the excitation interpolation.
Figure 6A:
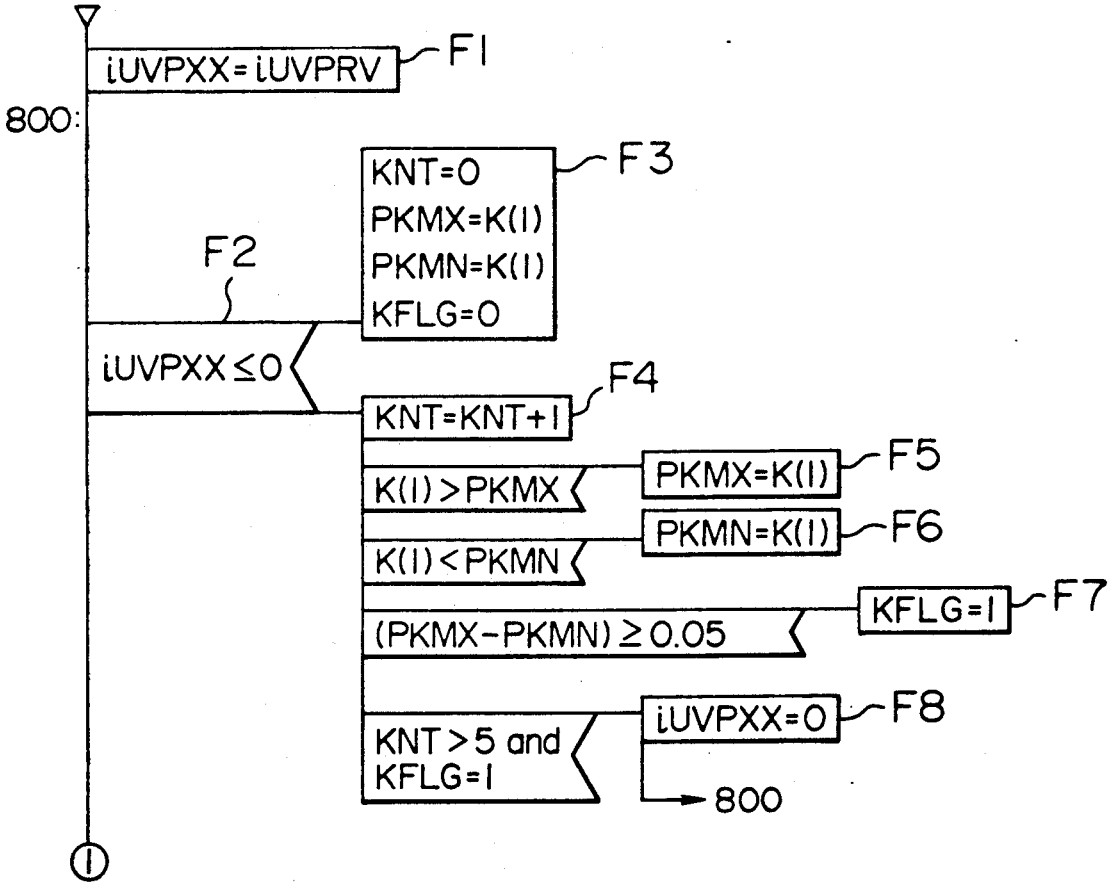
FIGS. 6*a*–6*c* are flowcharts showing the voiced excitation generation.
Figure 6B:
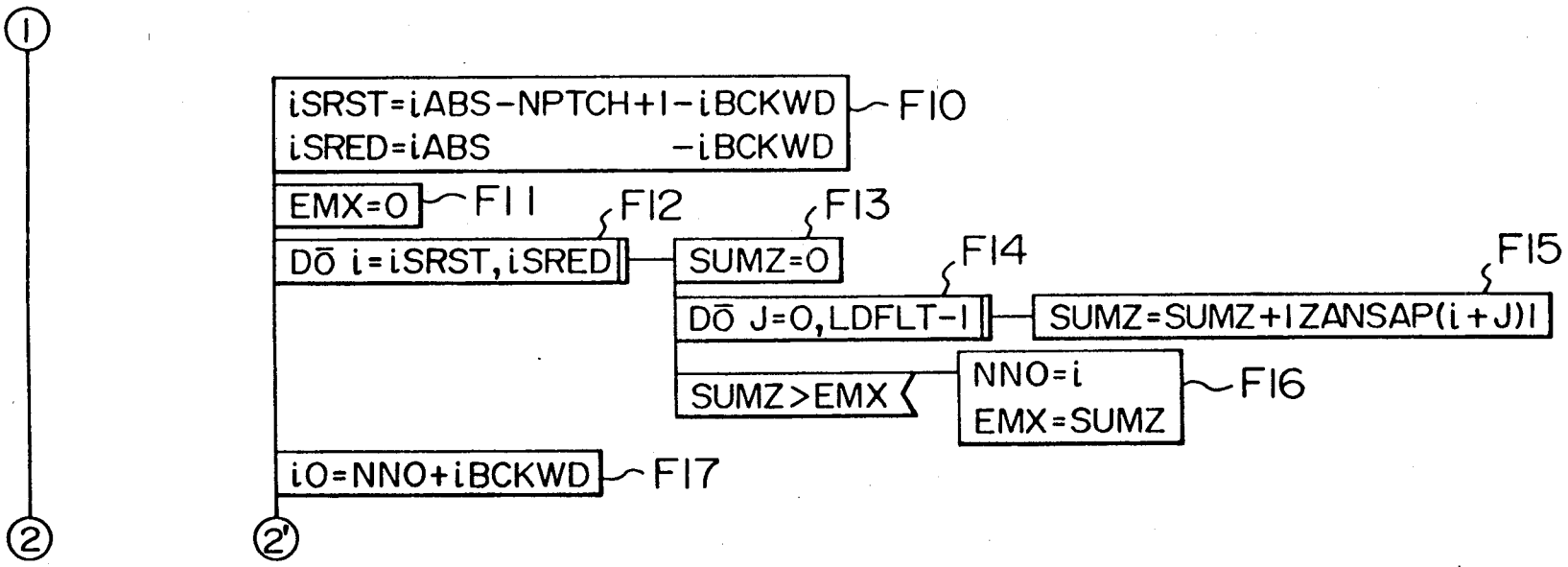
Figure 6C:
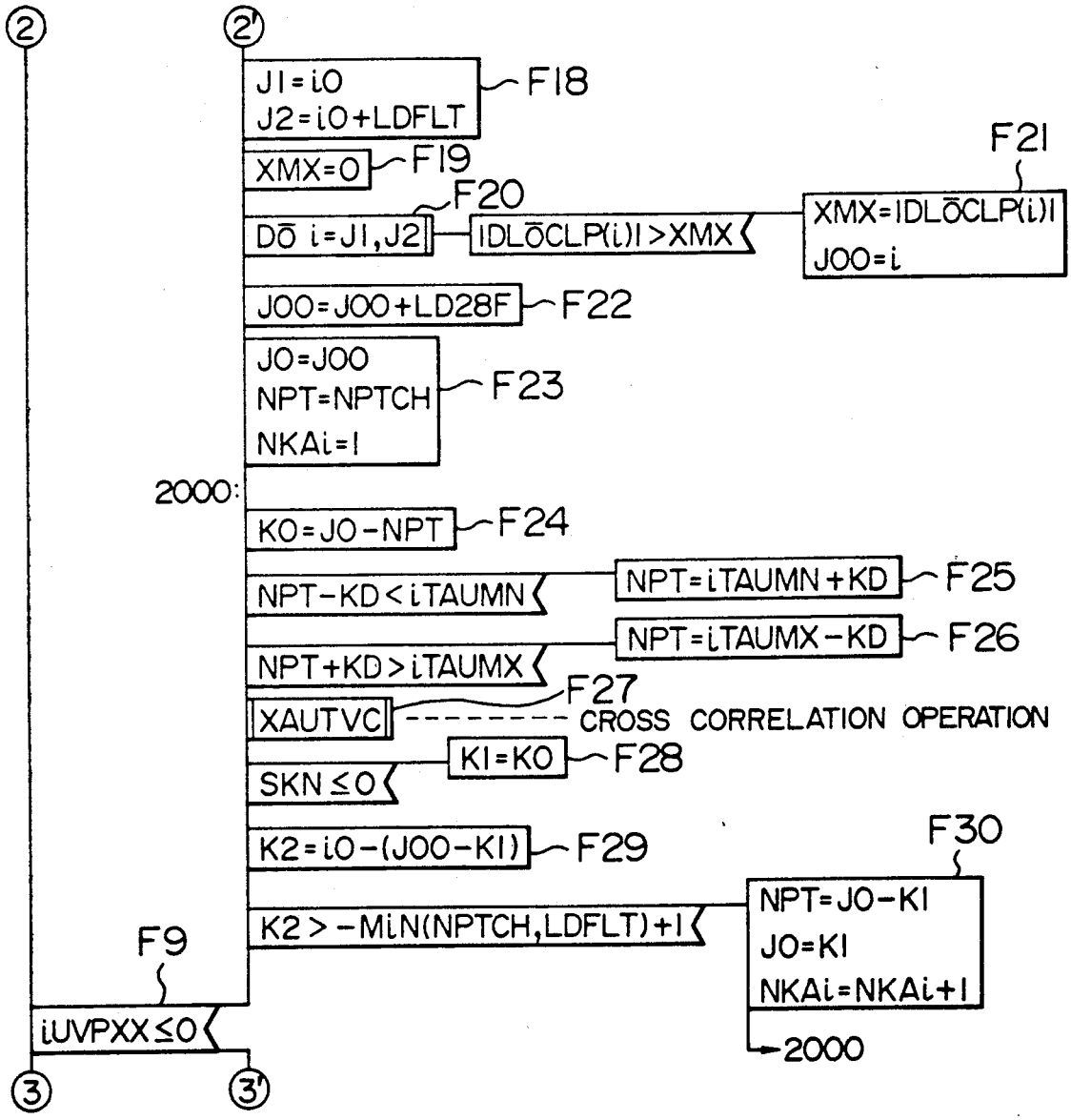
Figure 6D:
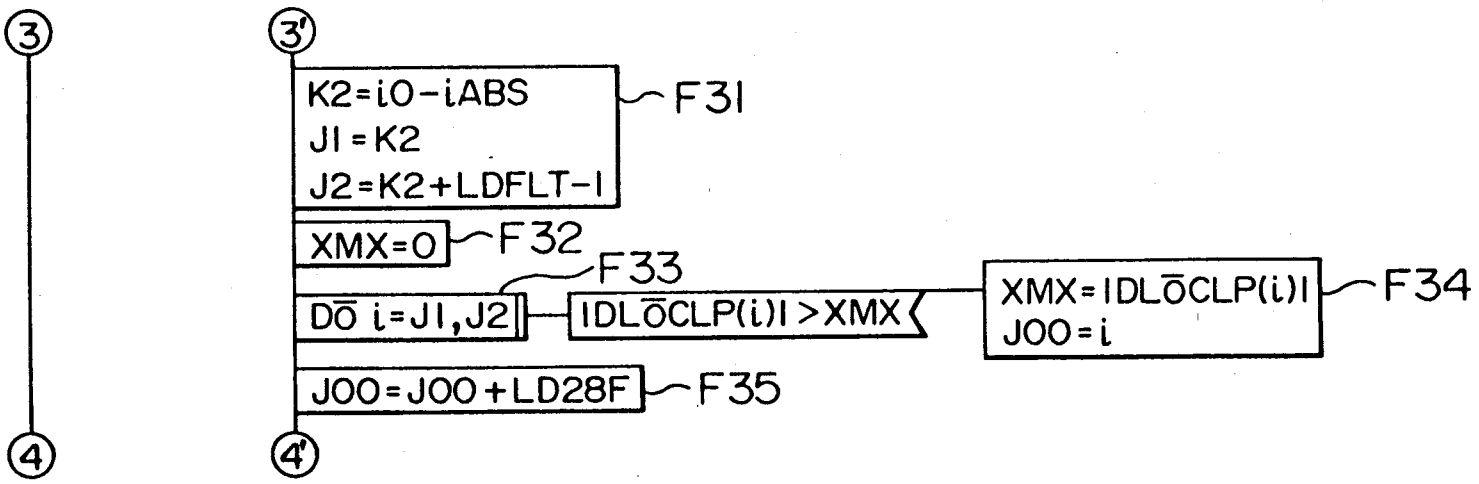
Figure 6E:
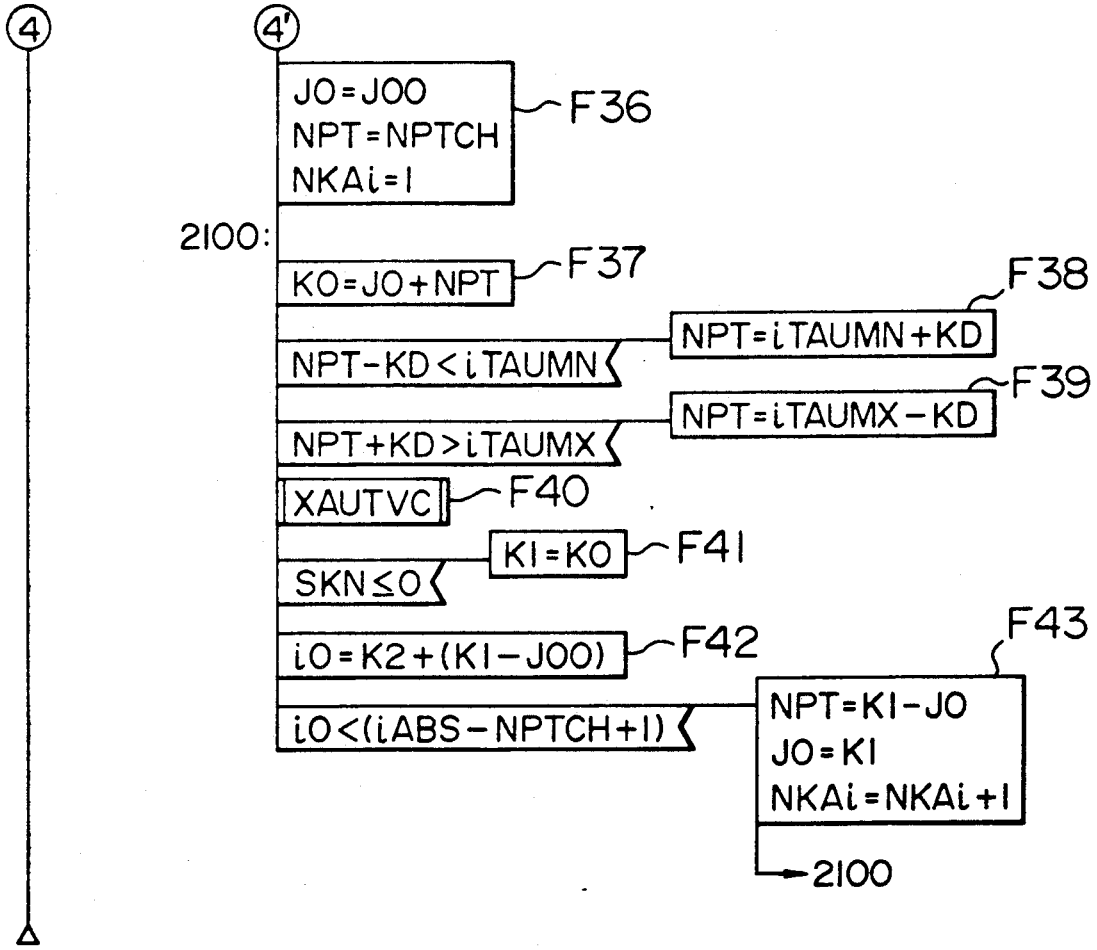

The excitation compensator 51 implements the following interpolation.

$$X_j = W_1 \cdot X_{ii} + W_2 \cdot X_{JJ} \quad (20)$$

where $X_{ii}$ and $X_{JJ}$ are excitation pulse amplitudes read out of the buffers 49 and 25, respectively, and $W_1$ and $W_2$ are weights read out of the above table. The interpolation result ($X_J$) 18 is delivered to the synthesis filter 20 and also stored in the buffer memory 25. These operations are carried out for all samples of the frame. FIG. 5 shows, in a sense of a model, the result of the foregoing interpolation process.

The excitation pulse generator 11 of this embodiment can readily be realized using an adder, correlator, comparator, and the like, as described above in detail. It is also possible to have the same function using a general-purpose microprocessor.

At the current frame, if the voice/unvoice judgement result 10a indicates "unvoice", the control signal from the switching controller 31 transfers control to the unvoiced excitation generator 116. The unvoiced excitation generator 116 operates to generate excitation pulses irrespective of the pitch period, as described in the prior copending U.S. patent application Ser. No. 15,025 filed on Feb. 12, 1987, and assigned to the assignee of the present invention. In this case, the decoding section does not implement interpolation for the representative residual 12', and it is directly delivered as the excitation of that frame.

In the foregoing example, when voiced frames continue, excitation pulses of the current frame are always produced in a manner of dependency to excitation pulses of the previous frame. However, even in this case, if the content of the speech is varying, the proper excitation pulse positions do not necessarily have a high correlation with excitation pulses of the previous frame. In such a case, even if a voiced frame continues, process is reset at a proper timing and excitation pulses are produced by the first generation means (independent extraction). This timing is determined when continuous voiced frames have reached a certain number and changes in K parameter have reached a certain number. The variation of K parameter is conceivably dependent on the variation of sound to some extent.

FIGS. 6a through 6e show the generation of voiced excitation pulses based on the foregoing procedure, and in this case it is carried out by a software means. The following describes the process flow of these figures.

Step F1 sets the value of flag iUVPRV, indicative of whether the previous frame is "voice", i.e., 1, or "unvoice", i.e., 0, to a variable iUVPXX.

Step F2 is a decision maker which selects the course of process depending on the value of iUVPXX, i.e., the process of F3 for iUVPXX=0 or the processes of F4 and successors for 1.

Step F3 reset various parameters. It clears the counter KNT for the voiced frame, and sets the value K(1) of the first-order parameter of the current frame to variables PKMX and PKMN which store the maximum and minimum values of the first-order K parameter (PARCOR coefficients). It resets the flag KFLG indicative of whether the number of voiced frames has exceeded a predetermined number (5 in this embodiment). The process proceeds to step F9.

Step F4 increments KNT by one.

Step F5 compares PKMX with K(1) and, if K(1) is larger, substitutes K(1) into PKMX.

Step F6 compares PKMN with K(1) and, if K(1) is smaller, substitutes K(1) into PKMN.

Step F7 compares the difference between PKMX and PKMN with a predetermined criterion (0.05 in this embodiment) and, if difference is larger, sets 1 to KFLG. The KFLG value of 1 signifies that the range of variation of the first-order K parameter has exceeded the specified value.

Step F8, if KNT is larger than the specified number of frames, i.e., 5, and KFLG is 1, transfers control to the process labeled by 800, otherwise transfers control to step F9.

Step F9 tests the value of IUVPXX and, if it is 0, transfers control to F10, or, if it is 1, transfers control to F31.

Step F10 through F30 are processes for the first excitation pulse extraction method (extraction of representative residual independently of the previous (frame) and for interpolation correspondence point detection.

Step F10 sets values to variables iSRST and iSRED. The iABS is the frame period (160 in this embodiment), NPTCH is the pitch period (calculated for each frame), and iBCKWD is a constant (−2 in this embodiment).

Step F11 sets 0 to the variable EMX which stores the maximum value of SUMZ.

Step F12 increments i by one from iSRST to iSRED, and causes steps F13-FF16 to repeat at each step execution.

Step F13 sets 0 to the variable SUMZ which stores the sum of absolute values of residual pulses.

Step F14 increments J by one from 0 to LDFLT −1, and causes step F15 to repeat at each step execution. LDFLT is the number of voiced representative residual pulses (28 in this embodiment).

Step F15 sums the sums of absolute values of amplitudes ZANSAP (i+J) of residual pulses at addresses i+J.

Step F16 compares SUMZ with EMX and, if SUMZ is larger, sets the value of i to NNO and the value of SMMZ to EMX.

Step F17 sets a value for the head address $i_0$ of the representative residual.

Step F18 sets values for J1 and J2.

Step F19 sets 0 to the variable XMX which stores the maximum value of absolute values of waveform amplitudes DOOCLP(i).

Step F20 increments i by one from J1 to J2, and causes step F21 to repeat at each step execution.

Step F21 compares the absolute value of the waveform amplitude DLOCLP(i) at address i with XMX and, if the absolute value is larger, substitutes it into XMX and stores the address i in JOO.

Step F22 modifies JOO by adding a constant LD28F (−9 in this embodiment) to it.

Step F23 sets values for JO, NPT and NKAi.

Step F24 sets a value for K0.

Step F25 compares NPT-KD with iTAUMN and, if NPT-KD is smaller, sets the value of iTAUMN+KD to NPT. iTAUMN is the minimum value in the pitch period search range, KD is the width of interpolation correspondence point search, and these values are 17 and 5, respectively, in this embodiment.

Step F26 compares NPT+KD with iTAUMX and, if NPT+KD is larger, sets the value of iTAUMX-KD to NPT. iTAUMX is the maximum value of the pitch period search range and it is 107 in this embodiment.

Step F27 calculates the correlation of waveforms to provide the maximum correlation value SKN and the corresponding address K1.

Step F28 sets the value of K0 to K1 if the value of SKN is negative.

Step F29 determines the address K2 of the portion having a greater correlation with the representative residual.

Step F30 tests whether K2 has entered the previous frame. In case of a negative test result, it revises the value of NPT, J0 and NKAi, and transfers control to the process labeled by 2000, or in case of a positive test result, it terminates the process with K2 being made the address of the interpolation correspondence point.

Steps F31 through F43 are processes of the second excitation pulse extraction method (extraction dependent on the representative residual of the previous frame).

Step F31 sets values for K3, J1 and J2. K2 is the representative residual head address $i_0$ of the previous frame transformed into the address system of the current frame, and J1 and J2 specify the search range of the maximum value of absolute values of waveform amplitudes.

Step F32 sets 0 to the variable XMX which stores the maximum value of the absolute value of waveform amplitude DLOCLP.

Step F33 increments iby one from J1 to J2, and causes step F34 to repeat at each step execution.

Step F34 sets the maximum value of absolute values of waveform amplitudes at addresses J1 to J2 to XMX, and sets the corresponding address to JOO.

Step F35 modifies the value of JOO by adding a constant LD28F to it.

Step F36 sets initial values for the variables J0, NPT and NKAi.

Step F37 sets the reference address K0 for searching the portion with high correlation with the representative residual of the previous frame.

Steps F38 and F39 modify NPT based on the value of NPT.

Step F40 calculates the cross correlation between the representative residual of the previous frame and the residual around the search reference point to provide the maximum correlation value SKN and the corresponding address K1.

Step F41 sets value of K0 to K1 when the SKN is negative.

Step F42 implements address conversion to provide a value for $i_0$.

Step F43 tests whether $i_0$ is at the end of the frame. If the test result is negative, it revises NPT, J0 and NKAi and transfers control to the process labeled by 2100; otherwise, it terminates the process.

Figure 7A:
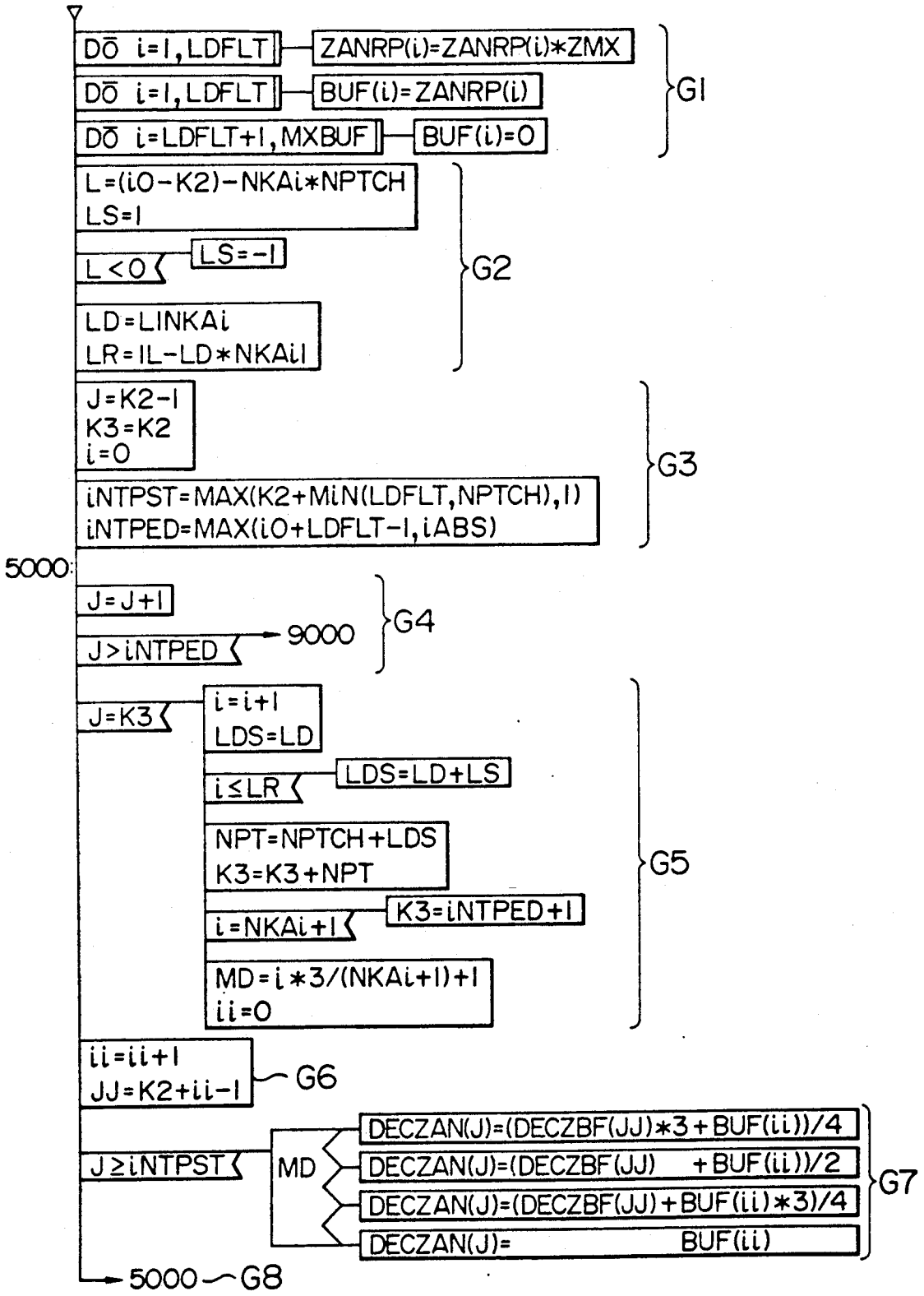
FIGS. 7*a* and 7*b* are flowcharts showing the decoding process.
Figure 7B:
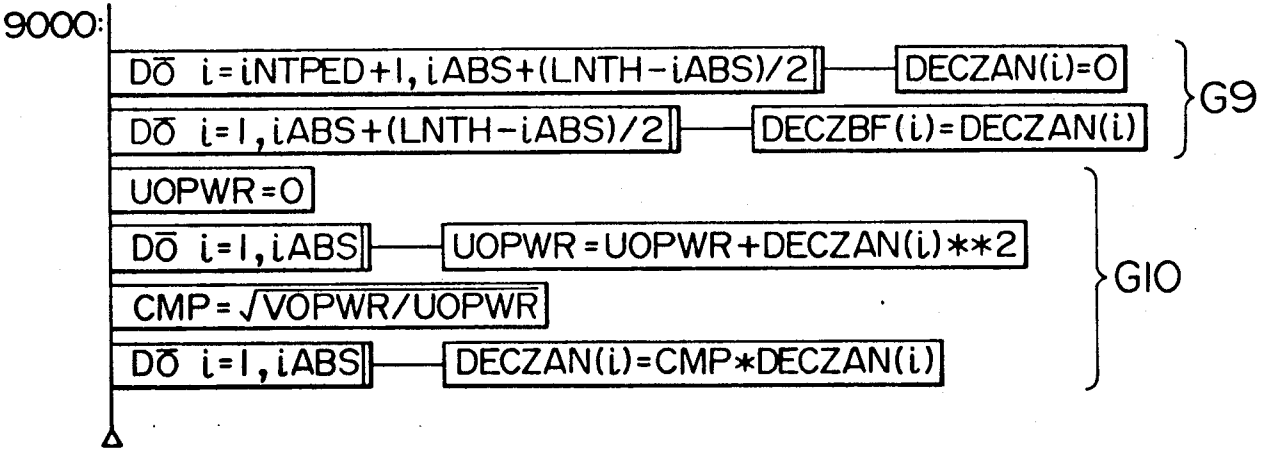

Next, the coding process realized by software will be described with reference to the flowcharts of FIGS. 7*a* and 7*b*.

Step G1 multiplies the amplitude (nomalized value) of the transmitted representative residual to the maximum value ZMX of the transmitted amplitude, and stores the result in the buffer BUF.

Step G2 sets the pitch interpolation parameters.

Step G3 sets the initial values of the residual interpolation parameters.

Step G4 increments J by one, compares it with INTPED, and transfers control to the process labeled by 9000 when 971 J has exceeded INTPED.

Step G5 revises the residual interpolation parameters when J becomes equal to K3.

Step G6 updates the addresses ii and JJ.

Step G7 implements the residual interpolation while selecting a weight in accordance with the weight mode MD.

Step G8 transfers control to the process labeled by 5000.

Step G9 stores the interpolated residual DECZAN in the buffer DECZBF so that it is used for the process of the next frame.

Step G10 modifies the amplitude of the interpolated residual so that the original residual power and interpolated residual power are consistent.

Figure 8A:
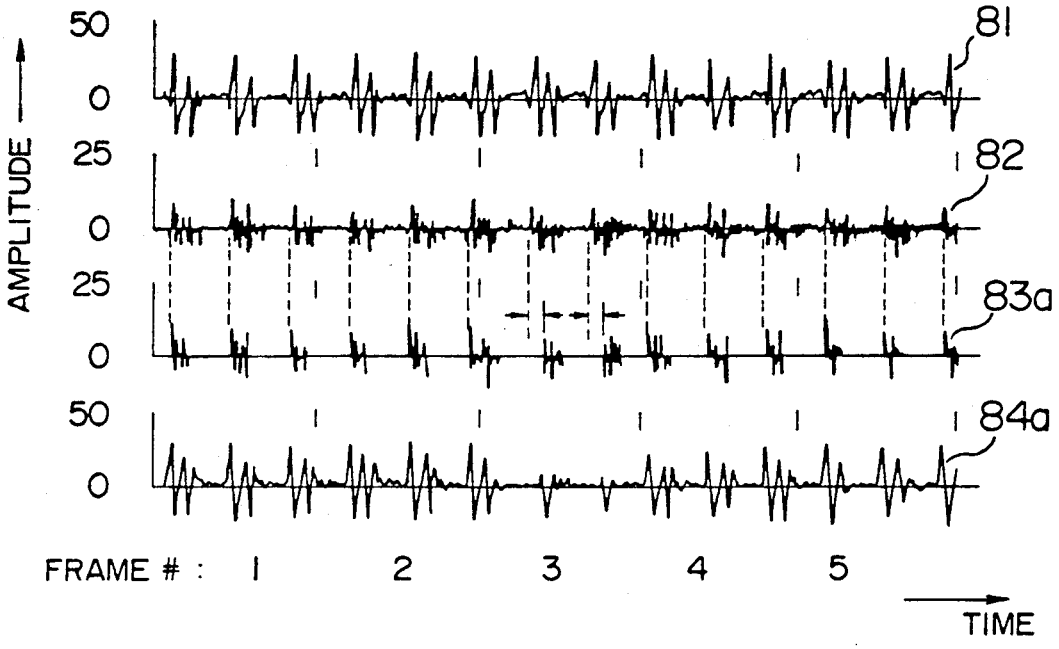
FIGS. 8*a* and 8*b* are waveform diagrams explaining the effectiveness of the invention.
Figure 8B:
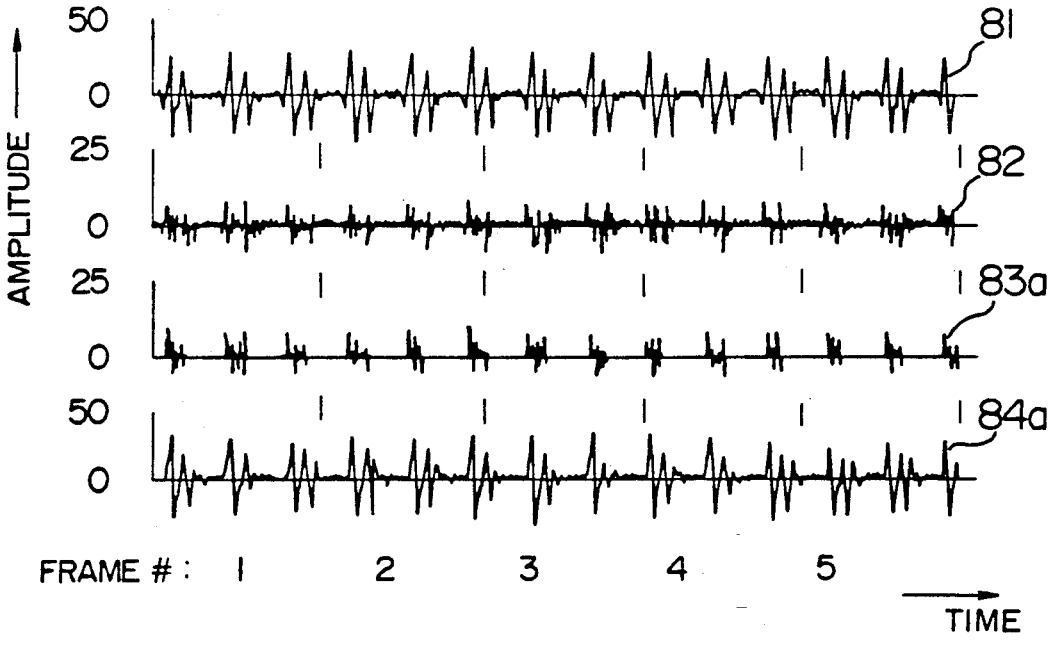

FIGS. 8*a* and 8*b* are examples of waveforms used to explain the effectiveness of this invention. Shown in FIG. 8*a* are the waveforms based on the conventional method, including the input speech wave 81, residual wave 82, representative residual wave 83*a*, and synthesized wave 84*a*. Shown in FIG. 8*b* are the waveforms based on this invention, including the input speech wave 81, residual wave 82, representative residual wave 83*b*, and synthesized wave 88*b*.

Both cases of FIGS. 8*a* and 8*b* have the same waveform of input speech, and the residual signal on the inverse filter 5 also has the same waveform 82. The conventional method, which extracts the representative residual (after decoding) for each frame independently, creates a displacement of representative residual in frame #3, resulting in a fluctuating periodicity, as shown on the waveform 83*a*. The pairs of arrows indicate the magnitude of displacement. As a result, the synthesized waveform 84*a* has its amplitude diminished at the position of displacement, as shown in FIG. 8*a*, and this incurs the degradation of sound quality.

Whereas, according to the foregoing embodiment of this invention, when voiced frames appear consecutively, the representative residual (after decoding) 83*b* is extracted dependently on the position of representative residual of the previous frame, as shown in FIG. 8*b*. This representative residual 83*b* has no displacement, and therefore the synthesized waveform 84*b* is free from amplitude reduction, producing more natural and enhanced sound quality as compared with the conventional case, as shown in FIG. 8*b*.

As described above, the inventive system generates excitation pulse trains without disturbing the periodicity inherent to the speech in response to the continuity of voiced sound, whereby the degradation of sound quality attributable to a fluctuating periodicity can be prevented and eventually the quality of coded speech can be enhanced.

We claim:

1. A speech coding system which analyzes a speech signal for each frame, separates the speech signal into spectral envelope information and excitation information and judges whether the speech signal is a voiced or unvoiced signal so that a plurality of pulses per pitch period are used as excitation for a voiced frame, the system comprising:

means for judging whether a current frame is a voiced frame which follows immediately after transition from an unvoiced frame, a voiced frame continuing from a voiced frame, or an unvoiced frame;

first excitation pulse generation means which generates plural excitation pulses per pitch period immediately following the transition from an unvoiced frame to a voiced frame;

second excitation pulse generation means which generates plural excitation pulses per pitch period in response to a continuing voiced frame; and third excitation pulse generation means which generates excitation pulses in response to an unvoiced frame;

wherein said second excitation pulse generation means determines excitation pulse positions of the current voiced frame based on the pitch period with respect to the excitation pulse positions of the voiced frame immediately preceding the current voiced frame, and generates an excitation pulse train at positions relative to the immediately preceding pulse positions.

2. A speech coding system according to claim 1, wherein a correlation method is used to determined the excitation pulse position of the current voiced frame.

3. A speech coding system according to claim 1, further comprising means for detecting a vocal change, excitation pulses being generated by said first excitation pulse generation means in response to the detection of a vocal change in a continuing voiced frame.

4. A speech coding system according to claim 3, wherein the detection operation of said vocal change detection means is based on the number of consecutive voiced frames and a value of variation in a K parameter (PARCOR coefficient) or a parameter derived from the K parameter.

5. A speech coding system using excitation pulse trains, comprising:

means for storing an input speech signal;

means for analyzing the speech signal for each section of predetermined length thereof to extract spectral envelope information, said section corresponding to each frame;

means for extracting a residual signal from the speech signal using said spectral envelope information, said residual signal including a plurality of pulses;

voice/unvoice judgement means which judges whether the current frame is a voiced frame or unvoiced frame, and detects a transition from an unvoiced frame to a voiced frame;

pitch extraction means for extracting the pitch period of the speech signal;

means for generating excitation pulses in response to the output of said voice/unvoice judgement means, said judgement means, (i) if the current frame is a voiced frame following an unvoiced frame, extracting plural pulses per pitch period as an excitation pulse train from said residual pulses within the last pitch section of the current frame and outputting a head address of said excitation pulse train and the amplitude of each pulse, or (ii) if the current frame is a voiced frame continuing from a voiced frame, determining the last pitch section of the current frame with reference to the head address of the excitation pulse train of the previous frame, setting the head address of the excitation pulse train of the current frame to be an approximate head address of said pitch section relative to the head address of the excitation pulse train of the previous frame, and outputting amplitudes of plural pulses per pitch period starting from said approximate head address; and means for quantizing and coding said spectral envelope information, voice/unvoice information, pitch information and information provided by said excitation extraction means.

6. A speech coding system according to claim 5, wherein if the current frame is a continuing voiced frame, the head address of excitation pulses is determined to be an integral part of a pitch section of the current frame with respect to the head address of the excitation pulse train of the previous frame.

7. A speech coding system according to claim 5, wherein if the current frame is a continuing voiced frame, the head address of excitation pulses is determined to be a position which provides a maximum cross correlation with said residual pulses within the current frame with reference to the excitation pulse train of the previous frame.

8. A speech coding method using excitation pulse trains comprising the steps of:

analyzing a speech signal for each section of predetermined length thereof to extract spectral envelope information, said section corresponding to each frame;

extracting a residual signal from the speech signal using said spectral envelope information, said residual signal including a plurality of pulses;

judging whether the current frame is a voiced frame or an unvoiced frame, and detecting a transition from an unvoiced frame to a voiced frame;

extracting the pitch period of the speech signal;

in response to the voice/unvoice judgement, (i) if the current frame is a voiced frame following an unvoiced frame, extracting plural pulses per pitch period as an excitation pulse train from said residual pulses within the last pitch section of the current frame and outputting a head address of said excitation pulse train and the amplitude of each pulse, or (ii) if the current frame is a voiced frame continuing from a voiced frame, determining the last pitch section of the current frame with reference to the head address of the excitation pulse train of the previous frame, setting the head address of the excitation pulse train of the current frame to be an approximate head address of said pitch section relative to the head address of the excitation pulse train of the previous frame, and outputting amplitudes of plural pulses per pitch period starting from said approximate head address; and quantizing and coding said spectral envelope information, voice/unvoice information, pitch information and excitation information.

9. A speech coding method according to claim 8, wherein, if the current frame is a continuing voiced frame, the head address of excitation pulses is determined to be an integral part of a pitch section of the current frame with respect to the head address of excitation pulse train of the previous frame.

10. A speech coding method according to claim 8, wherein, if the current frame is a continuing voiced frame, the head address of excitation pulses is determined to be a position which provides a maximum cross correlation with said residual pulses within the current frame with reference to the excitation pulse train of the previous frame.

11. A speech coding method comprising the steps of:

analyzing a speech signal for each frame thereof;

separating the signal into spectral envelope information and excitation information; and generating a plurality of pulse trains for excitation;

wherein a frame judged to be a voiced frame by voice/unvoice judgement means provided on a part of a coder is interpolated as to excitation to cause plural pulses per pitch period to be generated at a position relative to the previous pulse positions of the previous frame, each pitch period being extracted by pitch extraction means provided on another part of said coder.

12. A speech coding method according to claim 11, wherein said excitation interpolation is carried out between a plurality of pulse trains (representative excitation) extracted in said frame and excitation of a frame which has been coded before the first-mentioned frame.

13. A speech coding method according to claim 11, wherein, for said excitation interpolation, correspondence is made between the representative excitation extracted in said frame and coded excitation of said frame by a means provided on the part of the coder or the part of a decoder.

14. A speech coding method according to claim 12, wherein, for said excitation interpolation, correspondence is made between the representative excitation extracted in said frame and coded excitation of said frame by a means provided on the part of the coder or the part of a decoder.

15. A speech coding method according to claim 11, wherein said excitation interpolation is carried out in accordance with weights predetermined for each pitch period.

16. A speech coding method according to claim 11, wherein said representative excitation is extracted from a certain number of points including the last sample point of said frame.

* * * * *